US010109262B2

(12) United States Patent
Sheiner

(10) Patent No.: US 10,109,262 B2
(45) Date of Patent: Oct. 23, 2018

(54) APPARATUS AND METHOD FOR DOUBLE REED ASSEMBLY

(71) Applicant: Leonard Sheiner, Coral Springs, FL (US)

(72) Inventor: Leonard Sheiner, Coral Springs, FL (US)

( * ) Notice: Subject to any disclaimer, the term of this patent is extended or adjusted under 35 U.S.C. 154(b) by 0 days.

(21) Appl. No.: 15/610,622

(22) Filed: Jun. 1, 2017

(65) Prior Publication Data

US 2017/0352338 A1 Dec. 7, 2017

Related U.S. Application Data

(60) Provisional application No. 62/344,936, filed on Jun. 2, 2016.

(51) Int. Cl.
*G10D 9/02* (2006.01)

(52) U.S. Cl.
CPC ..... *G10D 9/023* (2013.01)

(58) Field of Classification Search
CPC ..... G10D 7/06; G10D 7/12; G10D 7/005; G10D 9/023
See application file for complete search history.

(56) References Cited

U.S. PATENT DOCUMENTS

| | | | | |
|---|---|---|---|---|
| 2,374,579 | A | 4/1945 | Brilhart | |
| 3,712,113 | A | 1/1973 | Roscoe | |
| 3,831,926 | A | 8/1974 | Sendoykas | |
| 6,706,958 | B1 | 3/2004 | Mitacek | |
| 7,872,186 | B1 * | 1/2011 | Tatman ..... | G10D 7/063 84/380 R |

FOREIGN PATENT DOCUMENTS

| | | | |
|---|---|---|---|
| EP | 0957469 | A1 | 11/1999 |
| EP | 2450875 | A1 | 1/2014 |

* cited by examiner

*Primary Examiner* — Kimberly Lockett
(74) *Attorney, Agent, or Firm* — Allen F. Bennett; Bennett Intellectual Property

(57) ABSTRACT

A method for assembling a double reed mouthpiece for use within an oboe utilizes heat shrink tubing to affix a folded cane to the staple of the mouthpiece. The staple is mounted on a ligating stand having a heatshield that protects a cork sleeve around the staple. Heat shrink tubing and a folded cane are then placed over the exposed proximal end of the staple. A clamp holds the folded cane in place. Heated air is used to ligate and affix the folded cane to the staple. The heatshield prevents damage to the cork sleeve. The heat shrink tubing securely affixes the folded cane to the staple.

7 Claims, 13 Drawing Sheets

Prior Art

FIG. 27
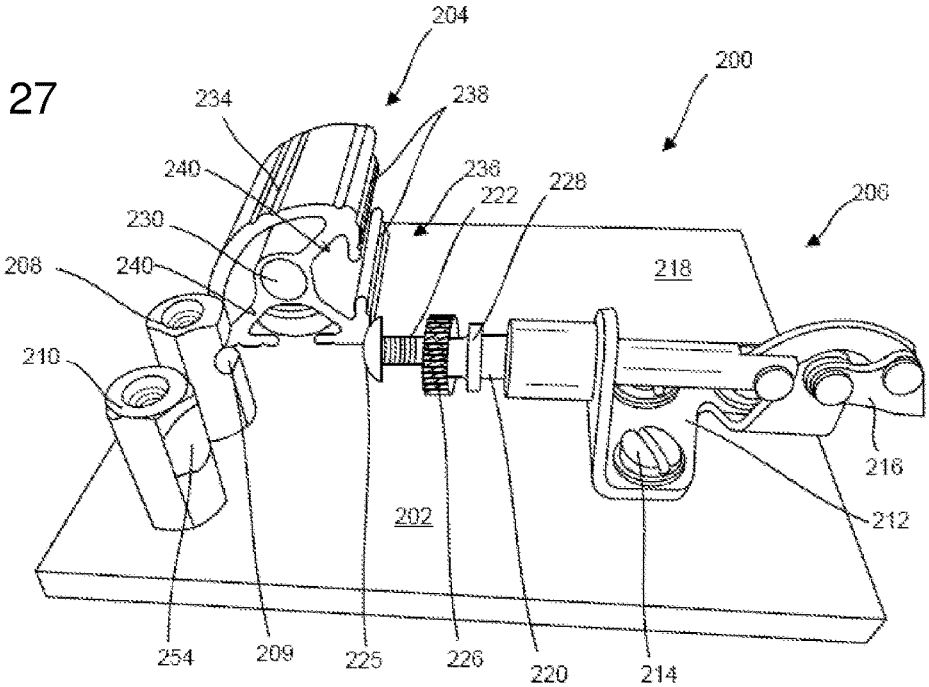
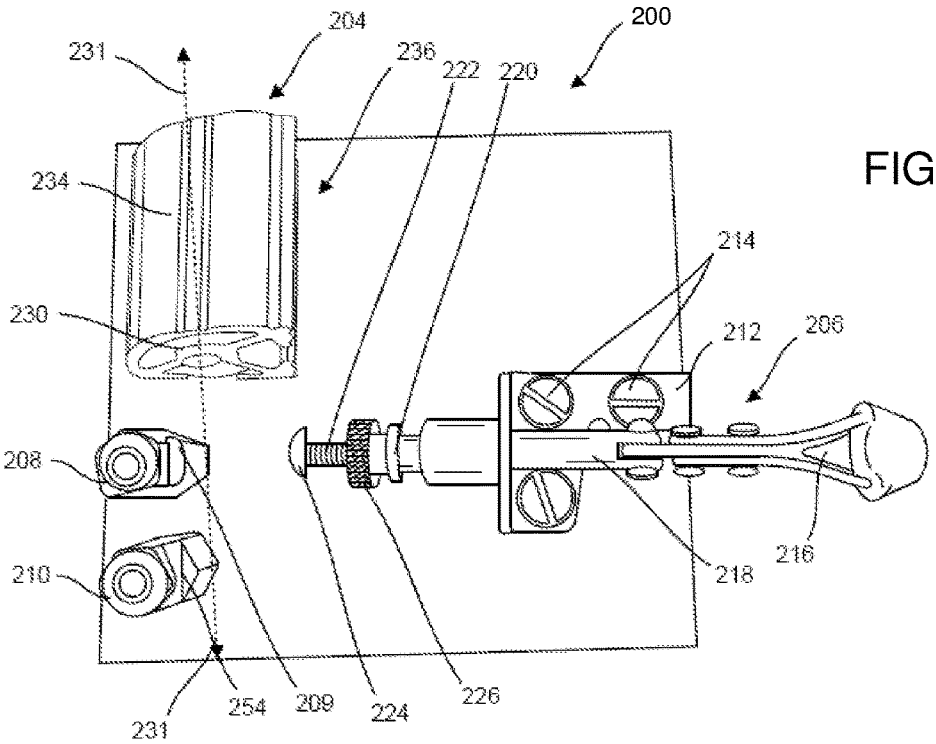
FIG. 28

APPARATUS AND METHOD FOR DOUBLE REED ASSEMBLY

CROSS-REFERENCE TO RELATED APPLICATIONS

This application claims priority to U.S. Provisional Application Ser. No. 62/344,936 filed on Jun. 2, 2016, the contents of which are hereby incorporated in their entirety.

STATEMENT REGARDING FEDERALLY SPONSORED RESEARCH OR DEVELOPMENT

Not applicable.

NAMES OF PARTIES TO A JOINT RESEARCH AGREEMENT

Not applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not applicable.

COPYRIGHT NOTICE

Not applicable

BACKGROUND OF THE INVENTION

Field of Endeavor

The present invention relates to systems and methods for assembling a double reed mouthpiece for use on musical instruments. More particularly, the invention relates to a mount and vice for positioning and securing a cane to a staple for use in musical instruments.

Background Information

Oboes, bassoons and other wind instruments use a double reed. The reeds used to form the mouthpiece are usually made from a piece of a cane plant, such as the *Arundo donax* cane. The nature and character of the reeds used for the double reed mouthpiece can make a large difference in the sound of a wood instruments.

Many professional oboists make their own reeds since every oboist needs a slightly different reed to suit his or her individual needs. By making their own reeds, oboists can precisely control factors such as tone colour and tuning. Occasionally, novice oboists may begin with a Fibrecane® reed, which is made of a synthetic material. Commercially available cane reeds are available in several degrees of hardness; a medium reed is usually used, and most beginners use medium-soft reeds. These reeds, like clarinet, saxophone, and bassoon reeds, are made from *Arundo donax*. As oboists gain more experience, they may start making their own reeds after the model of their teacher, or buying hand-made reeds (usually from a professional oboist) and using special tools including gougers, pre-gougers, guillotines, knives, and other tools to make the reed to their own liking.

In general, oboes require thicknesses of about 10 millimeters, bassoons of 20 to 25 millimeters. This allows each player to adjust the reeds precisely for individual embouchure, oral cavity, oboe angle, and air support. The reed is considered the part of oboe playing that makes it so difficult because slight variations in temperature, altitude, weather, and climate will change a perfectly working reed into an unplayable collection of cane.

To construct a double reed, a small piece of cane is cut to shape and the center portion is thinned (profiled). In the past, the two reeds were formed separately. Now it is more common to use a single piece of cane which is folded end to end to form the two blades of the reed. The open end of the folded cane is then placed over and around a small metal tube, referred to as the staple. The opposite end of the staple is surrounded by a sleeve of cork and is sized to fit snugly into the instrument. Typically, thread is used as a ligature, which is wrapped around the portion of the staple surrounded by the reed. The reed is then cut along the fold and scraped and shaped into a preferred configuration.

The structure of a common double reed for an oboe or other wind instruments described above is shown in FIGS. 1 and 2. The double reed 10 has an elongate substantially cylindrical staple 12 that often has a slightly oblong, oval or lens shape at its distal end 11 (as used herein "lens" refers to the mathematical two-dimensional shape formed by the intersection of two circles) and is typically cylindrical in its proximal region encased in the sleeve 14. The proximal end 17 of the staple 12 is circular. A cork sleeve 14 is shown at the proximal end of the double reed 10. The two members 16 of the double reed 16 overlay the distal end 20 of the staple 12. The ligature 18 consists of numerous loops of thread bound tightly over the reeds 16 and the staple 12. Generally, the ligature 18 lies flush against the distal end 15 of the sleeve 14 and have a length 19 that extends approximately 17 mm for a double reed for an oboe. The distal end 19 of the double reed 16 initially begins as a linear crease created by folding a single piece of cane over on itself to form the double reed. After the folded cane has been ligated to the staple, the distal end is cut and shaped using knives or other instruments.

Thus FIGS. 1 and 2 illustrates known prior arts designs for double reeds ligated, or attached, to a common cylindrical staple having a common cork sleeve over its proximal end. Staples are typically made of metal but may also optionally be formed from other suitable materials known in the art. Similarly, sleeves are typically made of cork but a variety of other materials known in the art may be used. The ligature 18 is generally composed of wire, strain, twine, monofilament, nylon or any of a variety of materials suitable for securely binding or ligating a double reed to a staple. The distal end 11 of the staple 12 is typically oblong, that is having a major access longer than a perpendicular minor axis. The major axis of the distal end 11 of the staple 12 is typically parallel to the linear crease that formed the distal end 19 of the double reed 16.

The process of applying the thread ligature to the folded cane can be very time-consuming and require considerable dexterity. Many oboe players prefer to fabricate their own reeds to their liking and this portion of the process is inefficient. In view of the foregoing, there is a need to provide a method for constructing a double reed that is efficient and neither time nor labor-intensive.

BRIEF SUMMARY OF THE INVENTION

Accordingly, the primary object of the present invention is to provide a unique method for assembling a double reed for an instrument.

In greater detail, a staple having a cork sleeve encasing its distal end is mounted on a ligating stand. The exposed proximal end of the staple first has heat shrink tubing placed over it. Next, a folded cane is positioned between the staple and the heat shrink tubing. A clamp holds the folded cane in place as heat is applied to shrink the tubing, thereby securing the cane to the staple. A heat shield protects the cork sleeve from damage during the process.

In one embodiment, A method of assembling a double reed mouthpiece comprises providing a staple having a proximal end and a distal end. The distal end is surrounded by a cork sleeve. An elongate piece of cane is folded in half to form a folded cane having a closed proximal end and an open distal end. The folded cane is placed between a piece of heat shrink tubing and the proximal end of the staple, the heat shrink tubing. A clamp secures the folded cane and the staple relative to each other. Heat shielding protects the cork sleeve. A sufficient amount of heat, usually using an air dryer, hot air gun or similar device, is applied to the heat shrink tubing such that it shrinks sufficiently to securely hold the folded cane to the staple.

In another embodiment, the method of manufacturing a double reed mouthpiece includes using a ligating stand having a mounting block for securing the folded cane and the staple relative to each other.

It is therefore an object of the present invention to provide a method of using heat shrink tubing to ligate a folded cane to a staple effectively and without damaging other portions of the mouthpiece.

It is another object of the present invention to provide a means for assembling a double reed for a wind instrument that requires less manual dexterity and provides a double reed assembly with no leaks.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 27 is a perspective view of an alternative embodiment of a device for ligating a double reed in accordance with the principles of the invention;

FIG. 28 is a top view of an alternative embodiment of a device for ligating a double reed in accordance with the principles of the invention;

DETAILED DESCRIPTION

Figure 1:
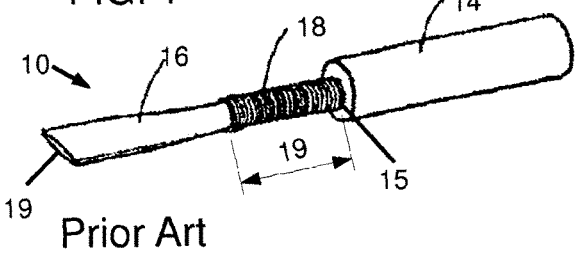
FIG. 1 is a perspective view of a double reed for an oboe of the prior art.
Figure 2:
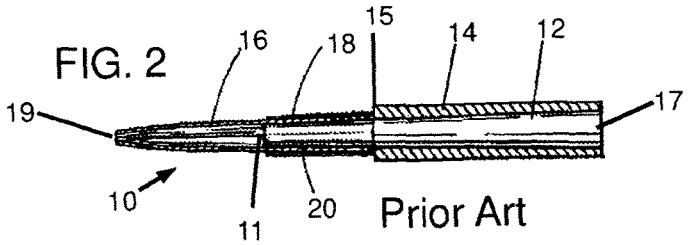
Prior Art FIG. 2
FIG. 2 is a cross-sectional view of a double reed for an oboe of the prior art.

The invention is not limited in its application to the details of the assembly and to the arrangements of the components set forth in the following description or illustrated in the drawings. The invention is capable of other embodiments and of being practiced and carried out in various ways. The phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. The term "cork" is used throughout the specification in reference to the material used to form the sleeve of the staple. Other materials, for example foam, are also suitable. Therefore, the term "cork" is to be interpreted as meaning "foam" or the suitable materials.

All of the implementations described below are exemplary implementations provided to enable persons skilled in the art to make or use the embodiments of the disclosure and are not intended to limit the scope of the disclosure, which is defined by the claims. There is no intention to be bound by any expressed or implied theory presented in the preceding technical field, background, brief summary or the following detailed description. The specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. For example, the invention and its principles are generally described throughout this document in relation to a double reed for an oboe. However, other double reed instruments that require reeds affixed to Staples by ligature are also suitable to the invention in its principles. The "distal" direction generally refers to the direction toward the lips of a person playing an instrument, and the "proximal" direction generally refers to the direction toward the instrument. That is, the distal end of the double reed extends away from an oboe, while the proximal end of the double reed is affixed to the oboe. Dimensions explicitly stated herein are exemplary only unless expressly stated otherwise.

Figure 3:
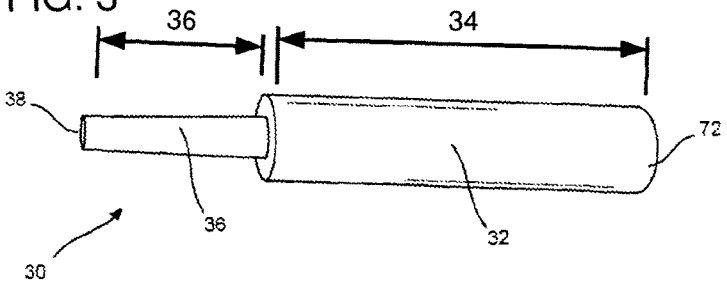
Prior Art FIG. 3
FIG. 3 is a perspective view of staple having a cork sleeve in accordance with principles of the invention.

Disclosed are devices and methods to facilitate the assembly of a double reed for an oboe or other instrument. These devices and methods may also be implemented in the construction of other double reed mouthpieces for other musical instruments. FIG. 3 shows a typical prior art double reed oboe staple 30 that may be used in accordance with the principles of the invention. The staple 30 is substantially cylindrical and has a cork sleeve 32 surrounding the proximal region 34 of the staple 30 all the way to the proximal end 72. The distal region 36 of the staple 30 is not covered by the sleeve 32, and 36 tapers down its length toward the distal end 38 which has a slightly oblong cross-section.

Figure 4:
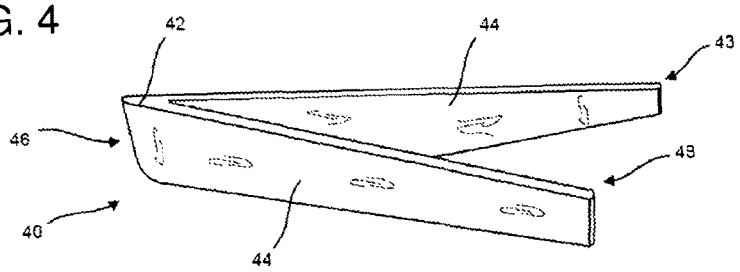
Prior Art FIG. 4
FIG. 4 is a perspective view of a folded cane in accordance with principles of the invention.

FIG. 4 shows a prior art piece of cane 40 that has been modified to be used as a double reed for an oboe in accordance with the principles of the invention. The cane 40 has been bent approximately 180° at crease 42, creating a folded cane 48 having two members 44 of equal length. The crease 42 forms the distal end 46, and the two members are of equal length, forming a proximal end 43 opposite to the distal end 46. Each of the reed members 44 has a slightly convex shape conforming somewhat to the oblong shape of the distal region 36 of the staple 30.

Figure 5:
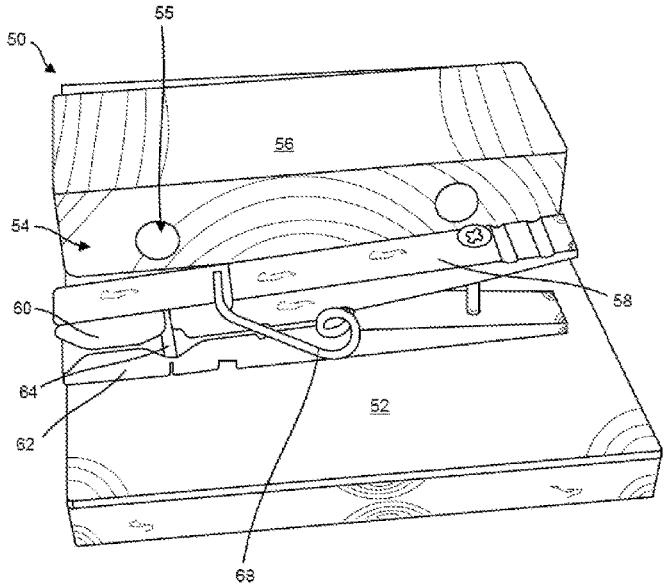
FIG. 5 is a perspective view of a ligating stand in accordance with principles of the invention.

FIG. 5 shows an embodiment of a double reed ligating stand 50 suitable for use in accordance with the principles of the invention. The ligating stand 50 has a planar horizontal base 52, a staple mount 54 having a central hole 55, heat shielding 56 and a reed clamp 58. In this embodiment, the heat shield 56 and the staple mount 54 are coextensive and formed from a single solid block of material, in this case wood. The central hole 55 consists of a bore extending through the mount 54 and configured to form a snug fit against a cork sleeve of a staple as shown in FIG. 3. The heat shield 56 protects the cork sleeve of a staple placed within the staple mount 54 from heat as explained in more detail below. In this embodiment, the staple mount 54 is integral with the heat shield 56 and they are formed as a single unitary body. However, the cork mount 54 and the heat shield 56 may be separate components.

The reed clamp 58 of this embodiment has a top jaw movable jaw 60 and a fixed jaw 62 forming a channel 64 between them sized and shaped to fit snugly around and securely hold a folded cane placed over a staple. Spring 68 creates a bias holding the clamp 58 in the closed position and retaining a folded cane and staple in a proper orientation.

Figure 6:
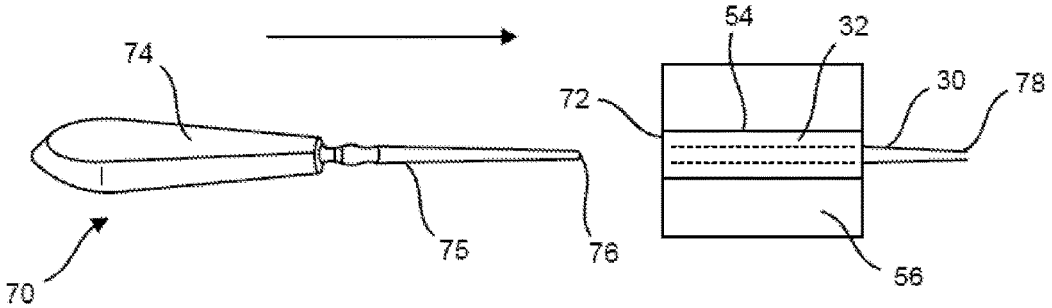
FIG. 6 is a partial cutaway view of a staple mounted on a ligating stand in accordance with the principles of the invention.

FIG. 6 shows the cross section of a staple 30 as shown in FIG. 3 inserted into the central hole 55 of the staple mount 54 within the heat shield 56 of a ligating stand 50. For clarity, the base and reed clamp are not shown in this Figure. As may be seen, when the staple 30 is placed within the staple mount 54, the cork sleeve 32 is completely covered by heat shielding 56 and only the distal region 36 of the staple 30 is exposed.

A mandrel 70 may optionally be inserted into the staple 30 via the opening 72. The mandrel 70 includes a handle 74 and is configured to the desired shape of a staple of a double reed oboe mouthpiece. The rod 75 is cylindrical near the handle 74 and tapers down to a tip 76 having an oblong cross section that is oval or lens shaped. If a staple 30 has a circular cross-section throughout, the staple 30 may be reamed by the mandrel rod 75 bend and shape the distal end of the staple so that it tapers to an oblong shape.

Figure 7:
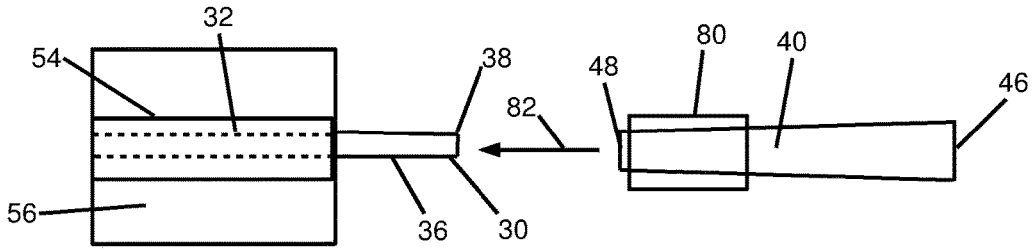
FIG. 7 is a partial cutaway view of a staple mounted on a ligating stand and a folded cane in accordance with the principles of the invention.

FIG. 7 shows the next step in constructing a double reed for an oboe. Once the staple 30 has been properly configured using the mandrel 70, a piece of heat shrink tube 80 is placed over the proximal end 43 of the folded cane 48. The proximal end 43 of the folded cane 48 is inserted in the direction of arrow 82 over the tip 38 and the proximal region 36 of the staple 30 until the open proximal end 43 abuts the cork sleeve 32. The heat shrink tubing will now extend over both the folded cane 40 and the proximal region 36 of the staple 30.

Figure 8:
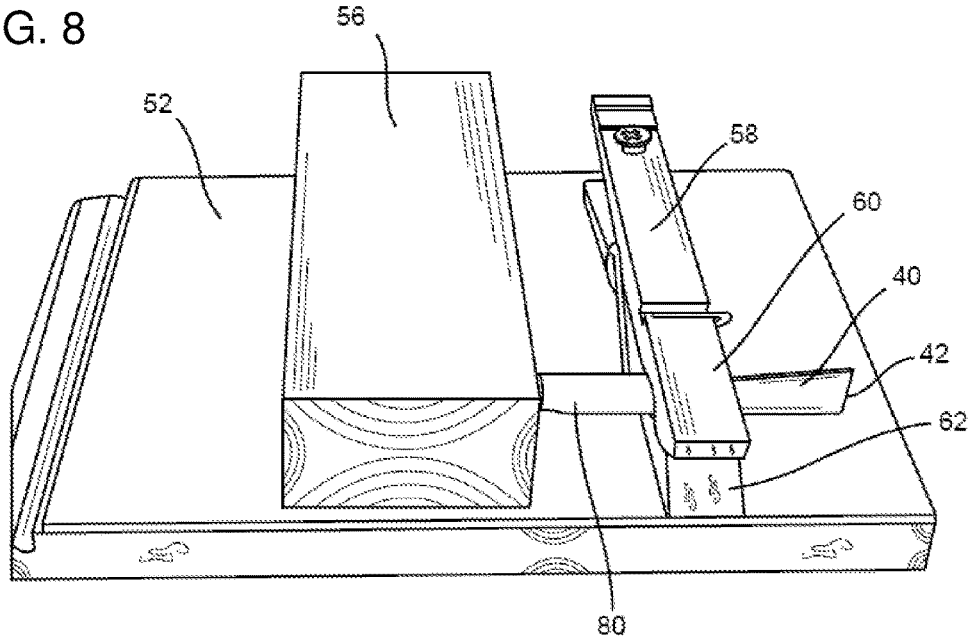
FIG. 8 is a perspective view of a staple, a folded cane and a heat shrink tube on a ligating stand in accordance with principles of the invention.
Figure 9:
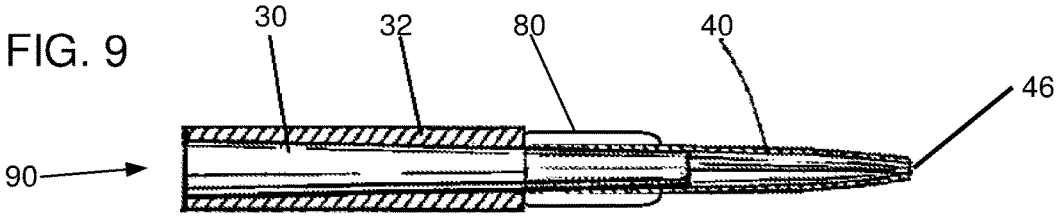
FIG. 9 is a cross-sectional view of a double reed for an oboe in accordance with the principles of the invention.
Figure 10:
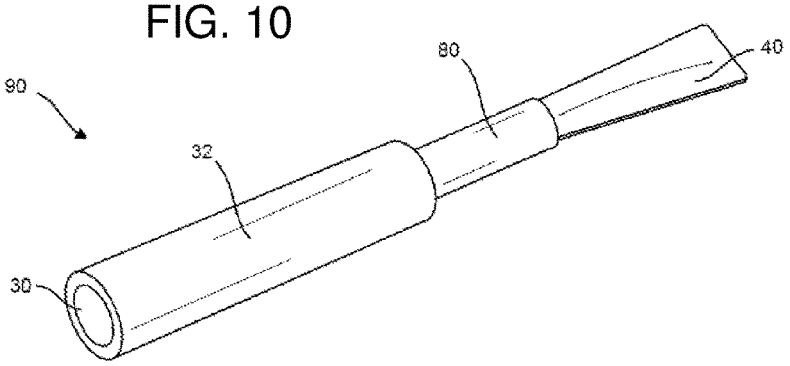
FIG. 10 is a perspective view of a double reed for an oboe in accordance with the principles of the invention.

FIG. 8 shows a staple 30 within the staple mount 54 inside heat shield 56 having the heat shrink tube 80 placed over the proximal end 36 of the staple 30 and the folded cane 40 inserted between the tube 80 and the staple 30. Reed clamp 58 has been applied to the reed 40 such that it is secured by the top jaw 60 and bottom jaw 62. The crease 42 at the distal end of the folded cane is parallel to the major axis of the oblong tip of the staple. In this embodiment, both the crease 42 and the major axis of the oblong tip of the staple are perpendicular to the planar surface of the platform 52. The heat shrink tube 80 is sized to have a length approximately equal to the distance between the heat shield 56 and the clamp 58. Once all of the components have been arranged and assembled as shown in FIG. 8, heated air may be applied to the heat shrink tube 80, causing it to shrink and tightly secure the reed 40 to the proximal end 36 of the staple 30 thereby ligating all of the components together. Heatshield 56 prevents exposure of the cork sleeve 32 to the heated air. Once the tube 80 has been sufficiently shrunk, the double reed mouthpiece 90 is fully assembled and ready for finishing as shown in FIGS. 9 and 10. In this manner, double reed mouthpieces for an oboe may be quickly and efficiently assembled.

Figure 11:
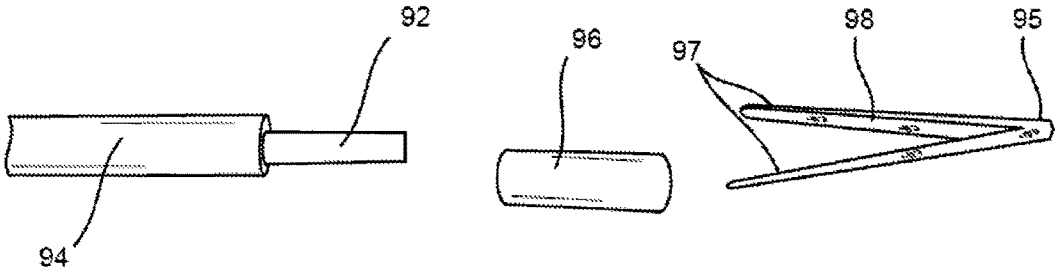
FIG. 11 is a perspective view of a staple, a heat shrink tube and a reed for use in assembling a double reed for an oboe.

FIG. 11 shows a staple 92 with a cork sleeve 94, a suitably sized piece of heat shrink tubing 96 and a reed 98 folded in half for use in constructing a double reed for an oboe as shown and described below. The double reed 98 is formed from two reed members 97 of approximately equal length formed by folding the folded cane 98, thereby creating a crease 95 at its distal end.

Figure 12:
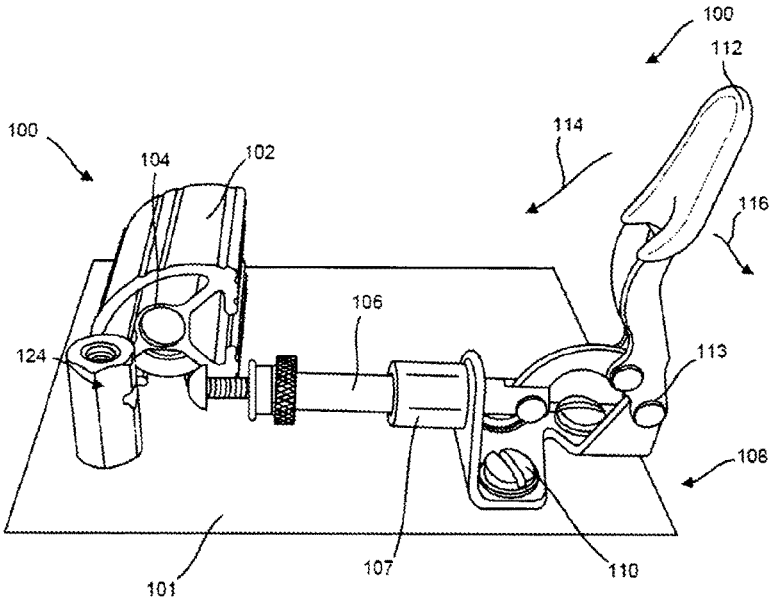
FIG. 12 is a front perspective view of a ligating stand in accordance with the principles of the invention.
Figure 13:
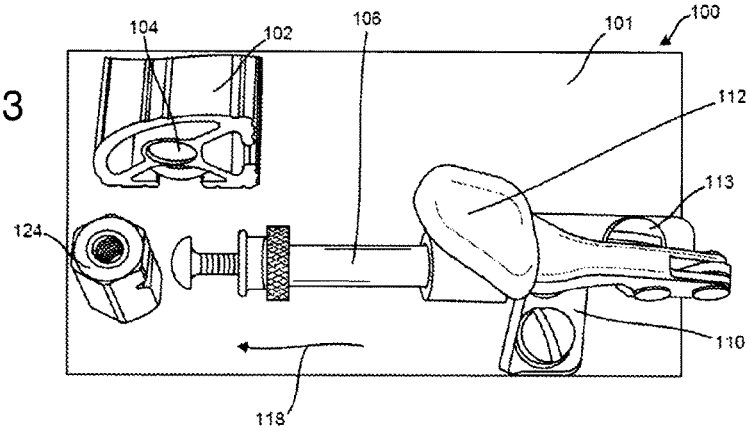
FIG. 13 is a top perspective view of a ligating stand in accordance with the principles of the invention.

FIGS. 12 and 13 show an alternative embodiment of a ligating stand 100. The ligating stand 100 of this embodiment is constructed upon a base 101. A staple mount 104 has a heat shield 102 extending over it to protect a staple and staple mount 104 from heat during the heat shrinking process. The staple mount 104 is not a bore in a solid block as shown in ligating stand 50 above. In this embodiment, the staple mount 104 comprises a cuff or sleeve that may or may not extend the full-length of the cork sleeve of the staple. A heatshield 102 comprises a curved plate or sheet sufficient to cover the sleeve to substantially protected from heated air during the shrinking of the tubing during the ligation process.

The staple mount 104 is positioned to hold a staple such that it is substantially perpendicular to the extending arm 106 of the clamp 108. Clamp 108 is secured in place by a mounting plate 110 and actuated by a lever 112 which pivots about a bolt 113. The extending arm 106 extends outward when the lever 112 moved in direction 114. The lever 112 can be pivoted about bolt 113 in direction 116 which retracts the extending arm 106. FIG. 12 shows the clamp 108 in a partially open position, and FIG. 13 shows the clamp 108 in the closed position.

FIGS. 14 to 21 show a method of the assembly a double reed in accordance with the principles of the invention utilizing the components shown in FIG. 11 and the ligating stand 100 shown in FIGS. 12 and 13.

Figure 14:
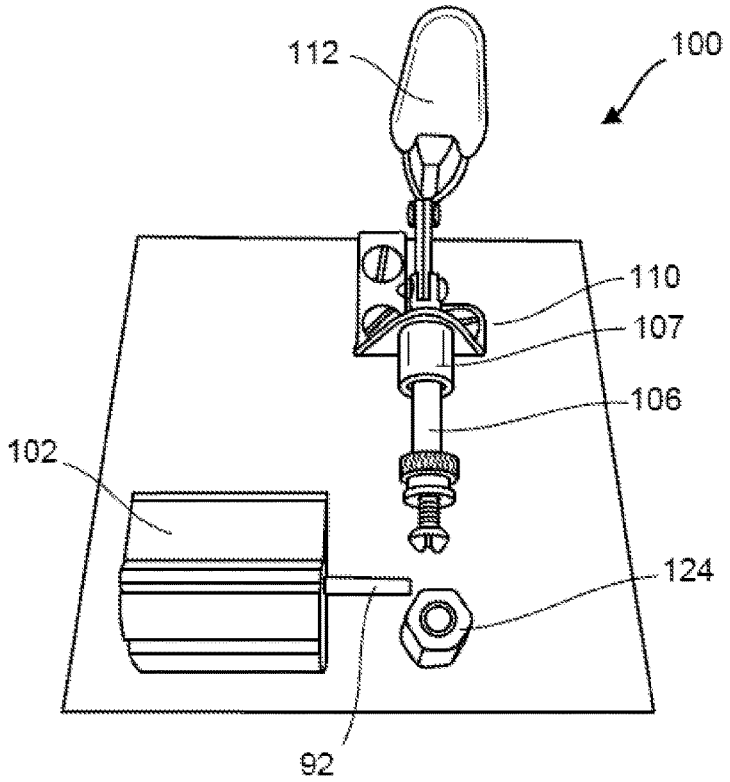
FIG. 14 is another top perspective view of a ligating stand and a staple in accordance with the principles of the invention.
Figure 15:
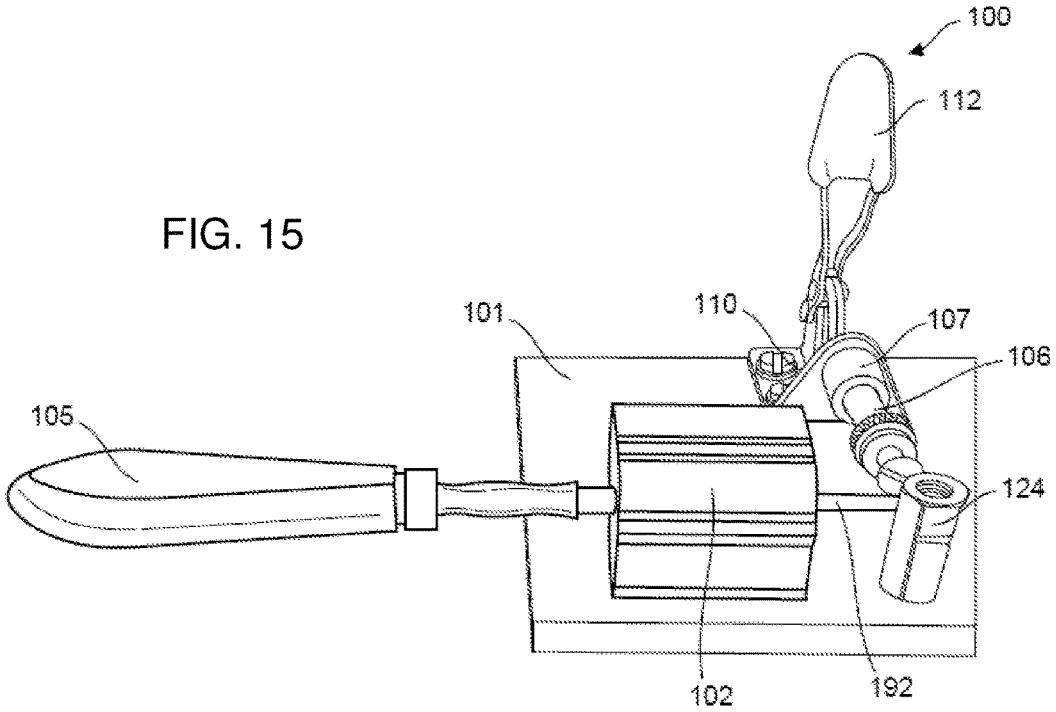
FIG. 15 is a side perspective view of a ligating stand, a staple and a mandrel in accordance with the principles of the invention.

FIG. 14 shows the first step in constructing a double reed. The staple 92 has been placed within the staple mount 104. The cork sleeve 94 is entirely within the staple mount 104. FIG. 15 shows a subsequent step in which a mandrel 105 is inserted into the end of the staple 92 in order to properly shape the staple.

Figure 16:
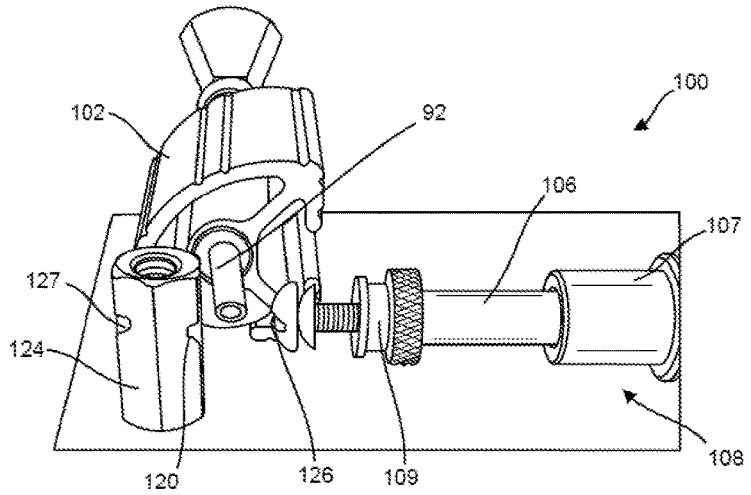
FIG. 16 is a front perspective view of a ligating stand, a staple in a mandrel in accordance with the principles of the invention.

FIG. 16 shows the ellipsoidal shape of the end of the staple 92. The clamp 108 of this embodiment is configured to engage the pointed sides of the folded cane. Therefore, the staple 92 is oriented with the flatter sides on the top and bottom. The extending arm 106 may include an adjustable extension 109 that allows the user to fine-tune the distance between the extending arm 106 and the bolt 124 to a size appropriate for the double reed being constructed.

Figure 17:
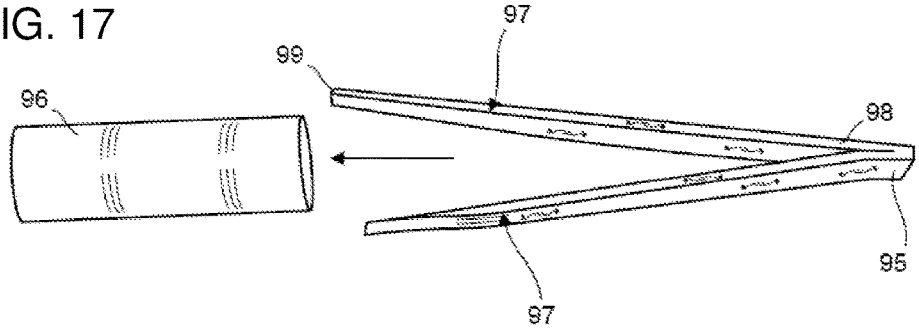
FIG. 17 is a perspective view of a piece of heat shrink tubing and a reed in accordance with principles of the invention.
Figure 18:
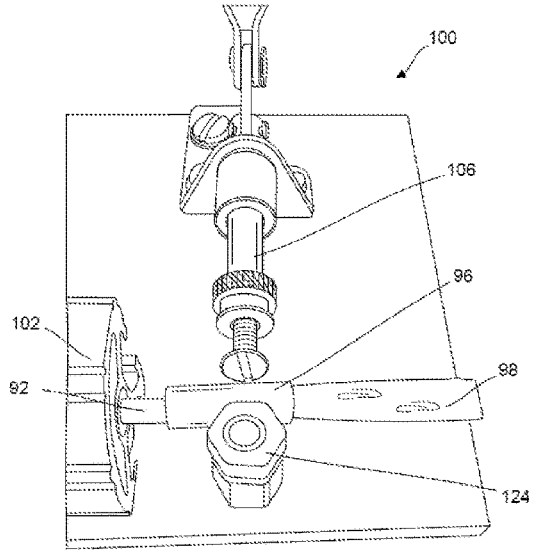
FIG. 18 is a top perspective view of a ligating stand, a staple, a heat shrink tube and a reed in accordance with principles of the invention.

Next, as shown in FIG. 17, the opposing members 97 of the folded cane 98 are compressed and the proximal end 99 is inserted into and through the heat shrink tubing 96. Once this has been done, the folded cane 98 and the heat shrink tubing 96 is placed over the portion of staple 92 that extends out of the staple mount 104 as shown in FIG. 18.

Figure 19:
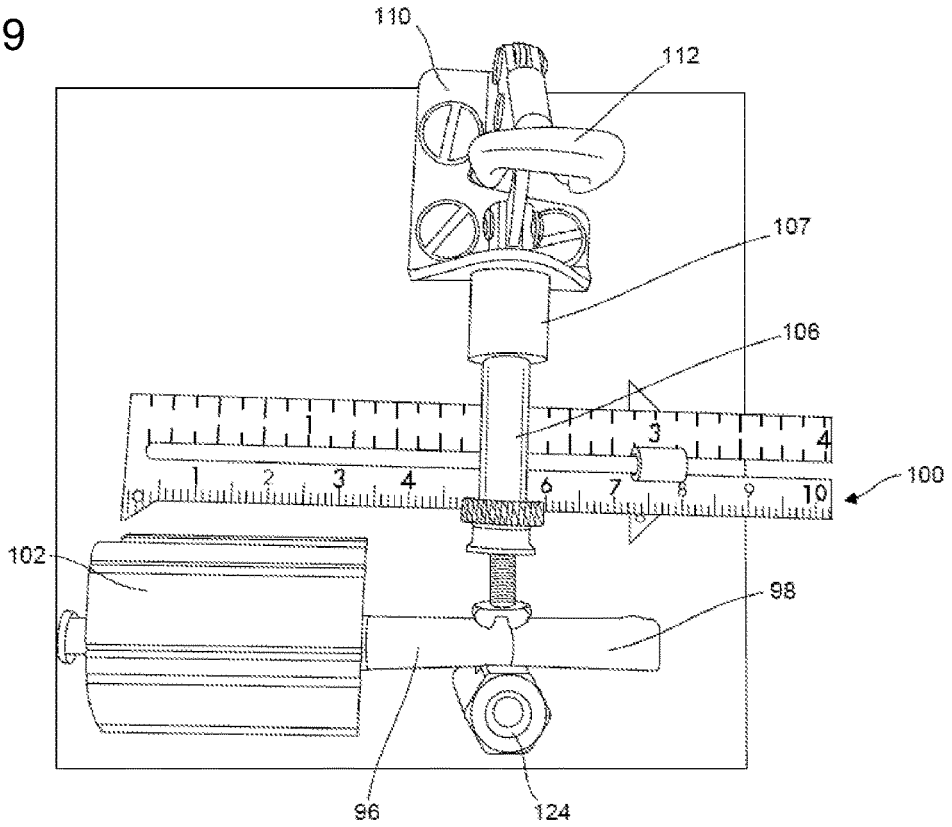
FIG. 19 is a top perspective view of a ligating stand, staple, a heat shrink tube and a reed in accordance with the principles of the invention.
Figure 20:
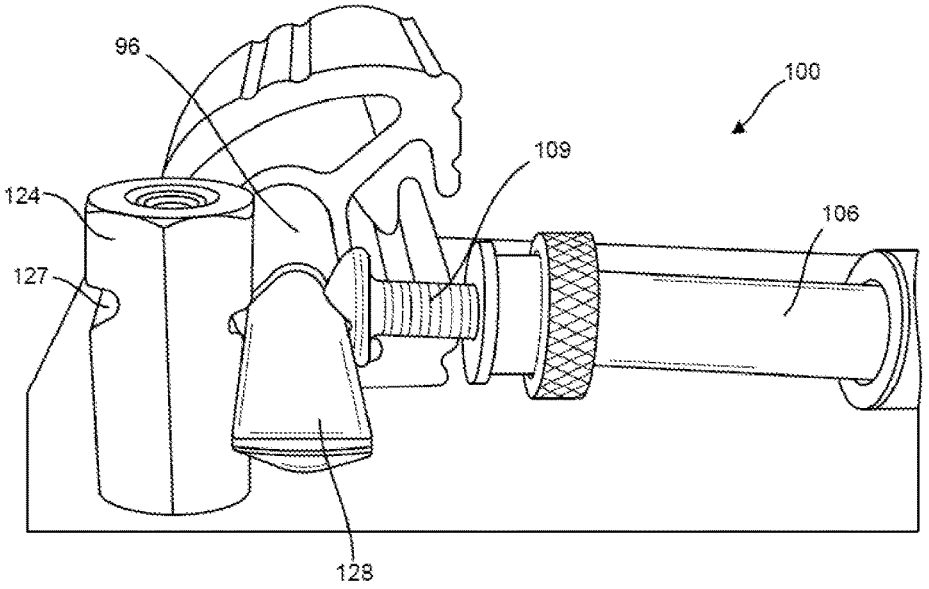
FIG. 20 is a front perspective view of a ligating stand, a staple, a heat shrink tube and a reed in accordance with the principles of the invention.
Figure 21:
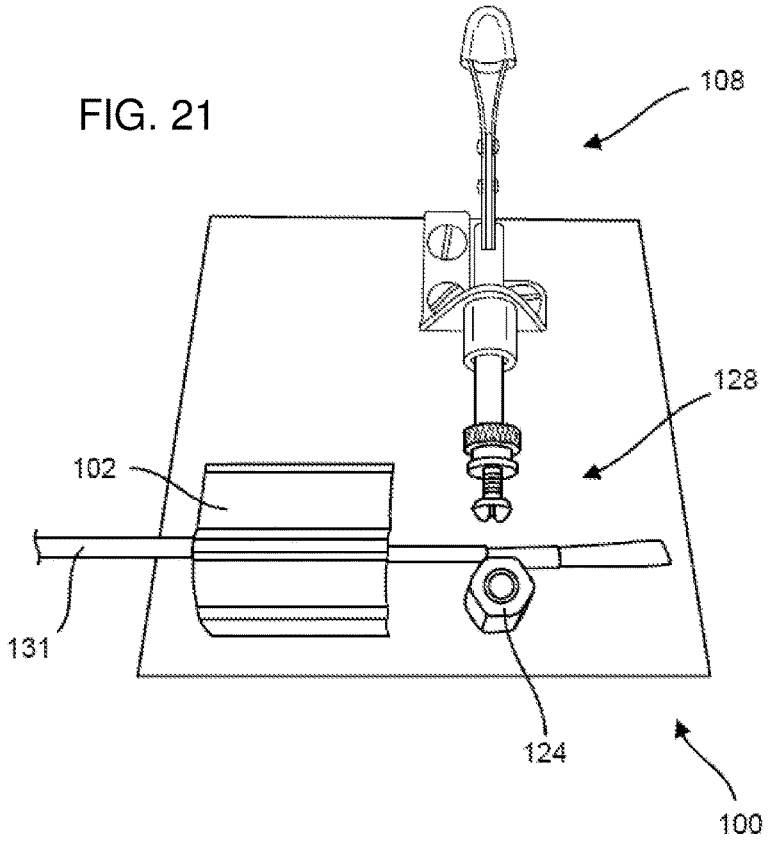
FIG. 21 is a top perspective view of an assembled double reed for an oboe being removed from a ligating stand in accordance with the principles of the invention.

Referring now to FIGS. 19 and 20, it can be seen that the linear crease 95 is oriented horizontally and parallel to the platform 101. Once the components have all been properly positioned on the ligating stand 100, the clamp 108 is actuated such that the extending arm 106 extends outward and impinges upon the folded cane 98 and may also impinge upon the heat shrink tubing 96. The extending arm 106 has a notch 126 configured to complement and engage one side of the folded cane 98. An opposing notch 120 on post 124 is similarly configured to lie flush with the sides of the folded cane 98. Cuff 107 holds the extending arm 106 in a proper orientation. When the extending arm 106 is fully extended in the direction of arrow 118, both sides of the folded cane 98 are engaged by opposing notches 120 and 126. Notches 120 and 126 may be configured in order to hold the double reed 128 and a preferred shape while the heat shrink tubing is applied in order to secure it to a staple. The post 124 may optionally be rotatable and may include a second notch 127 sized and configured to accommodate a double reed of a size and shape different from a double reed complementary to the notch 120.

Once the double reed 128 has been fully assembled on the ligating stand 100, heat is applied to the heat shrink tube 96 such that it shrinks and ligates the folded cane 98 to the staple 92 in a secure friction fit. At this point, the extending arm 106 may be retracted and the double reed 128 is assembled and ready for finishing and may be removed from the staple mount 104 using a ramrod 131 or similar device.

Figure 22:
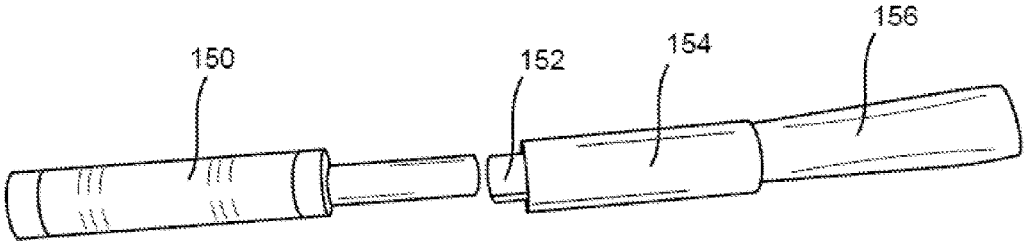
FIG. 22 is a perspective view of a substrate, a staple, a heat shrink tube and a reed in accordance with an alternative embodiment of a method for assembling a double reed in accordance with the principles of the invention.
Figure 23:
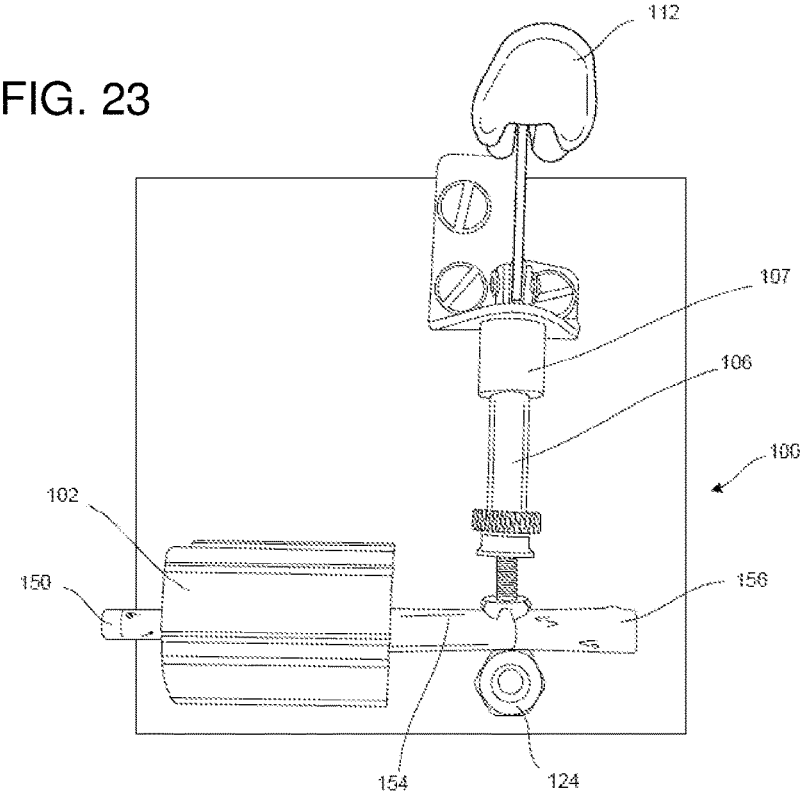
FIG. 23 is a top perspective view of a ligating stand, a substrate, a staple, a heat shrink tube and a reed in accordance with an alternative embodiment of a method for assembling a double reed in accordance with the principles of the invention.
Figure 24:
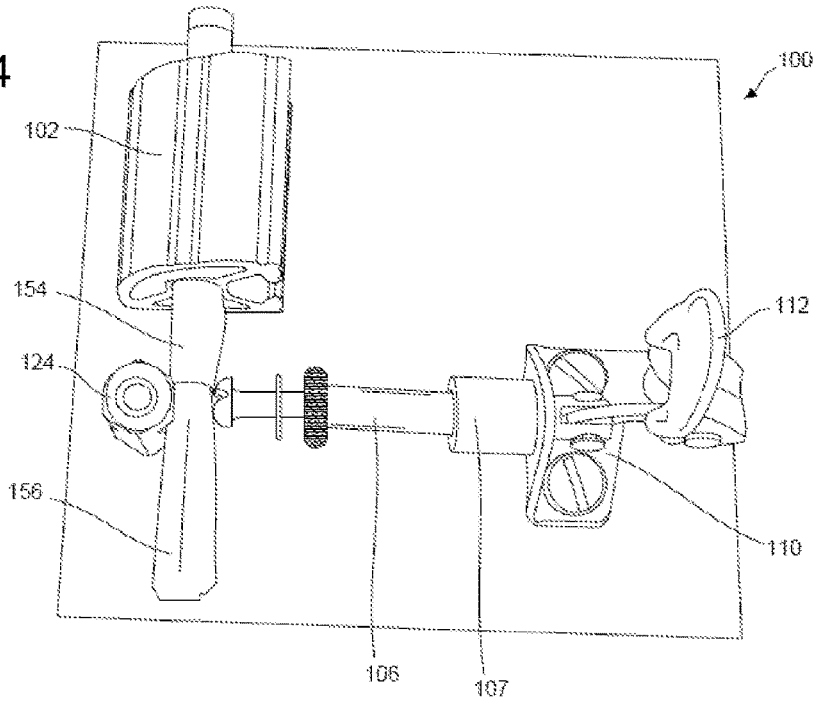
FIG. 24 is another top perspective view of a ligating stand, a substrate, a staple, a heat shrink tube and a reed in accordance with an alternative embodiment of a method for assembling a double reed in accordance with the principles of the invention.
Figure 25:
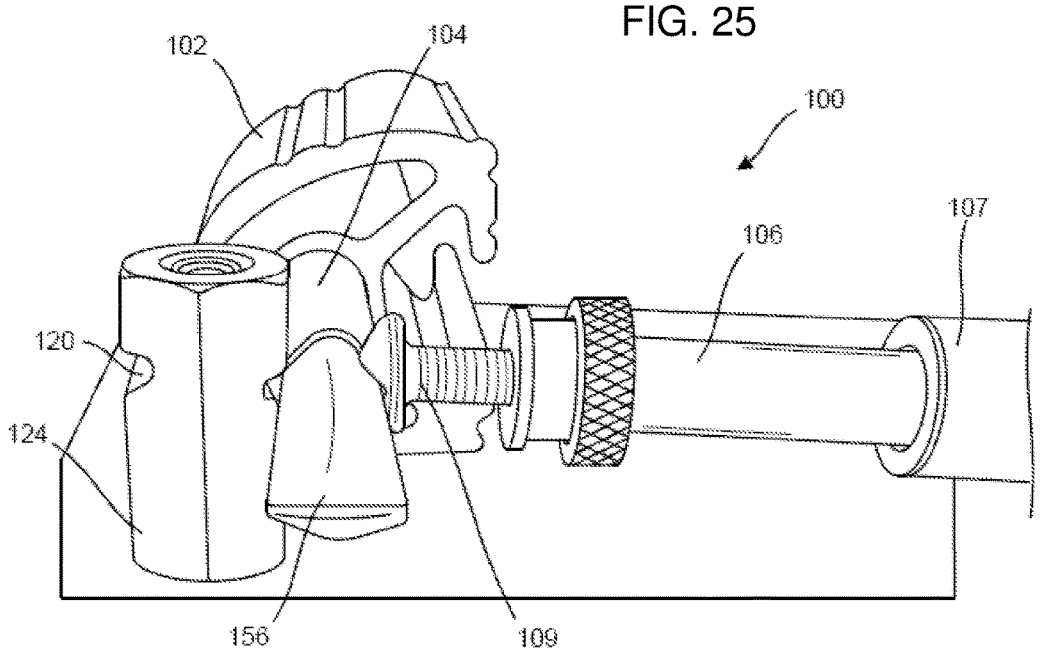
FIG. 25 is a front perspective view of a ligating stand, a substrate, a staple, a heat shrink tube and a reed in accordance with an alternative embodiment of a method for assembling a double reed in accordance with the principles of the invention.

FIG. 22 shows a substrate 150 that consists of a staple having a cork sleeve similar or equivalent to the staples and cork sleeves shown above. The substrate 150 is used to assemble a double reed for use with a bassoon, English horn or other instruments that use a double reed that is placed upon a bocal. The substrate 150 includes a staple with a tip substantially similar to a bocal which it is intended to imitate. Also shown are a staple 152, heat shrink tubing 154 and a folded cane 156. The folded cane 156 has been placed over the staple 152 and the heat shrink tubing 154 has been positioned over both. FIGS. 23-25 shows the devices in FIG. 22 used with a ligating stand to assemble a double reed that may be affixed directly to the bocal of an instrument.

The ligating stand 100 having the substrate 150 placed within the staple mount 104. The staple 152, folded cane 156 and heat shrink tube 154 are assembled on the staple portion of the substrate 150 that is protruding from the staple mount 104. An operator then actuates the lever 112 to extend the extending arm 106 and restrain the folded cane 156 and heat shrink tube 154 firmly in place between the extending arm 106 and the post 124. Depending upon the size and configuration of the double reed, the post 124 may be rotated such that the desired notch 120 or 127 engages the folded cane 156.

Figure 26:
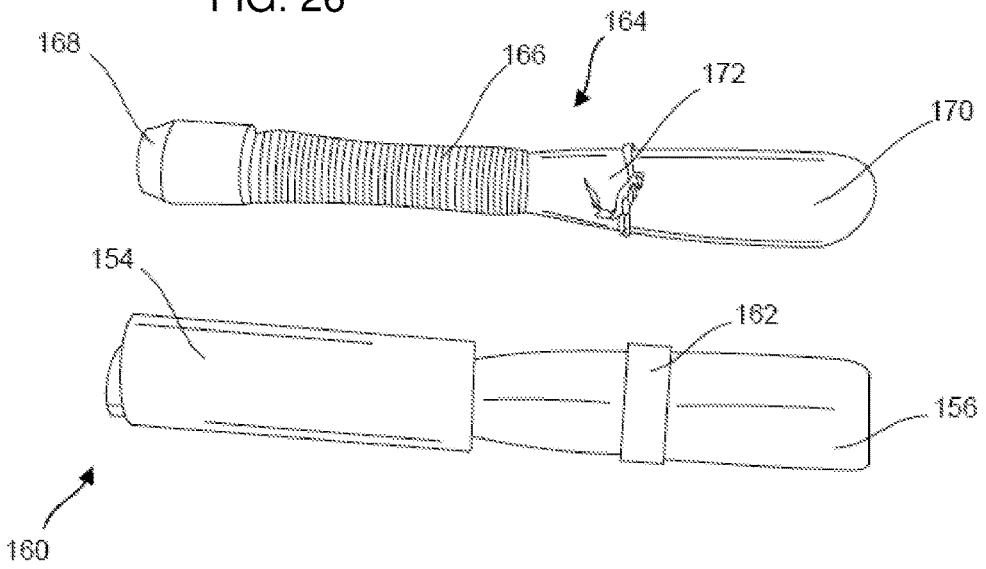
FIG. 26 is a perspective view of a prior art double reed and a double reed in accordance with the principles of the invention.

Heat is an applied to the heat shrink tubing 154 so that it shrinks and tightens around the folded cane 156 and the staple 152. As a result, the double reed 160 is assembled and secured by means of friction fit. FIG. 26 shows the double reed 160 with an additional ligature 162 about the folded cane 156. With bassoons and English horns it is sometimes desirable to include the additional ligature 162. Double reed 160 in FIG. 26 is positioned alongside a double reed 164 of the prior art. The prior art double reed 164 has a folded cane 170 secured to a staple 168 by many coils of thread 166. The second ligature 172 consists of a piece of wire that has been wrapped around the folded cane 170 and twisted to secured in place. This type of second ligature 172 is unattractive and may also pose a hazard of cutting and operators lip when an instrument is being played.

FIGS. 27-32 show another alternative embodiment of a device 200 for ligating a folded cane to a staple of a mouthpiece for a wind instrument in accordance with the principles of the invention. The device 200 has a flat, horizontal planar platform 202. Attached to the platform 202 are a staple mount 204, a toggle clamp 206, a fixed jaw post 208, and a reed alignment post 210. The device 200 is similar to the device shown in FIGS. 12-25, but has a rotating staple mount 204 and the folded cane and staple are aligned differently relative to the platform. This embodiment 200 also utilizes a reed alignment post 210 that defines the length of the assembled double reed and the fixed jaw post 208 is complimentary to an appropriate length of heat shrink tube. The alignment post 210 locates the tip of the folded cane in three dimensions. Thus, the device 200 in accordance with principles of the invention allows for all of the components to be properly located and firmly held in place versus manually holding the reed components. For example, the device 200 of this embodiment is sized to accommodate a heat shrink tube approximately 17 mm long. However, those skilled in the art will appreciate that different length tubes are also suitable.

The toggle clamp 206 and fixed jaw post 208 combined together to form a reed clamp. The toggle clamp 206 includes a base plate 212 that is affixed to the platform 202 by screws 214. A lever 216 may be actuated to move the plunger 218 in a horizontal direction parallel to the platform 202. The distal end 220 of the plunger 218 has a spindle 222 extending distally from it and the direction of the fixed jaw post 208. The spindle 222 is threaded and may be twisted in order to adjust the overall length of the plunger 218 so that the spindle tip 224 is positioned at a desired distance from the fixed jaw post 208 wherein the plunger 218 is fully extended. A jam nut 226 may be rotated along the spindle 222 until it abuts nut 228, thereby locking the spindle 222 in place. The spindle tip 224 includes a movable jaw plate 225 perpendicular to the spindle 222 and plunger 218. The movable jaw plate 225 includes a groove 227. The fixed jaw post 208 includes a fixed jaw groove 209 opposing the groove 227 of the movable jaw plate 225. The movable jaw plate 225 and groove 227 work in conjunction with the fixed jaw groove 209 to securely clamp a folded cane in place during the ligating procedure, as explained in more detail below.

The staple mount 204 includes a central hole 230 extending through the staple mount 204 completely. The central hole 230 defines a longitudinal axis 231 parallel and concentric to the central hole 230. A heatshield 234 extends over the staple mount. Because the staple mount 204 and heat shield 234 are metallic, a hollow insulating cavity 237 separates the heatshield 234 from the central hole 230. Ambient air the us acts as an insulator underneath the heatshield 234. The staple mount 204 also includes a framework 236 that includes heat dissipating fins 238 and heat dissipating arms 240. The staple mount 204 is pivotally attached to the platform 202 by a pivot pin, not shown. This allows the staple mount 204 to rotate around a vertical axis perpendicular to the platform 202.

FIG. 28 shows the staple mount 204 slightly rotated in a direction 232 to that the longitudinal axis 231 moves away from the fixed jaw post 208 and toward the toggle clamp 206. This orientation makes it easier to insert a staple into the staple mount 204 and to place the folded cane and heat shrink tube over the distal end of the staple.

Figure 29:
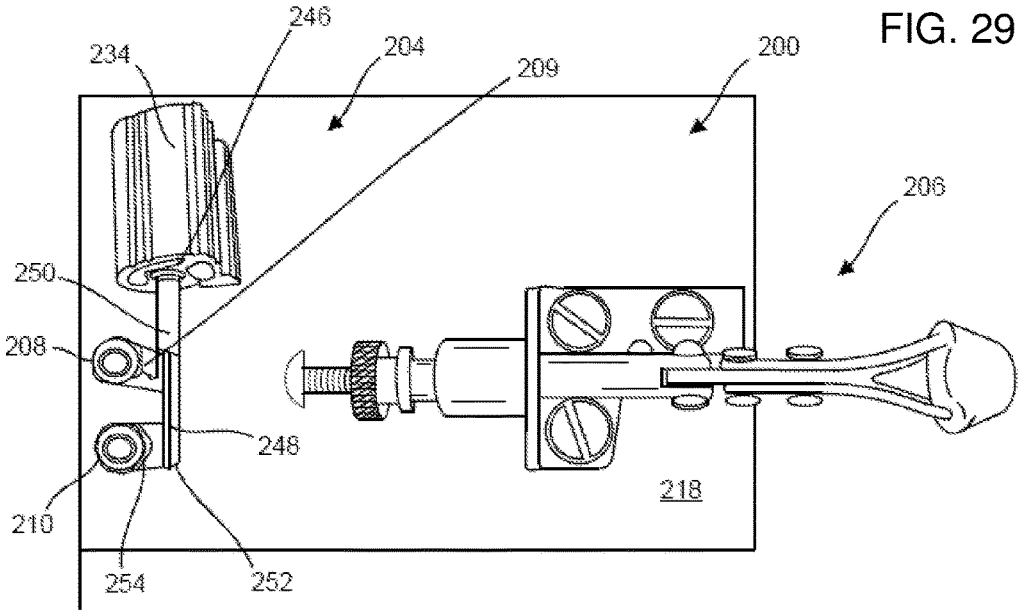
FIG. 29 is a top view of an alternative embodiment of a device for ligating a double reed in accordance with the principles of the invention.

FIG. 29 shows a staple 246 inserted into the hole 230. A folded cane 248 and a heat shrink tube 250 have been placed over the staple 246 in the same manner as described above, except that the crease 252 forming the distal end of the folded cane 248 is aligned perpendicularly to the horizontal plane of the platform 202. The heat shrink tube 250 has a length 254 that is equal to the distance between the staple stand 204 and the fixed jaw post 208. Once the staple 246, the folded cane 248 and the heat shrink tube 250 have been properly positioned, the staple stand 204 is again rotated, this time in the opposite direction to place the device 200 and the staple 246 in the configuration shown in FIG. 30.

Figure 30:
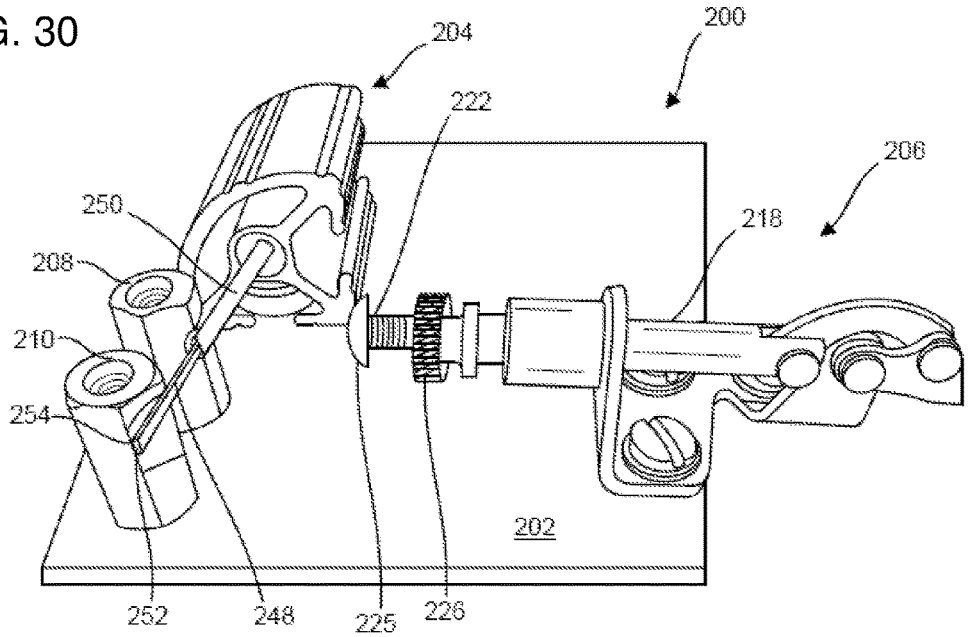
FIG. 30 is a perspective view of an alternative embodiment of a device for ligating a double reed in accordance with the principles of the invention.

FIG. 30 shows the heat shrink tube extending between the staple stand 204 and the fixed jaw post 208. The folded cane 248 extends from the opening of the central hole 232 its distal end 252 having a crease aligned perpendicularly to the platform 202. The reed alignment post 210 has a rectangular notch 254 sized and configured to align with the reed 248. When the staple stand 204 has been rotated in the clockwise direction, opposite to direction 231, the folded cane 248 will fit snugly with in the rectangular notch 254 and life flush against. Similarly, the folded cane 248 also lies with end and flush against the notch 209 of the fixed jaw post 208. When the staple stand 204 has been properly positioned so that folded cane 248 is located in the reed notch 254 and jaw groove 209 and lies flush against them, the toggle clamp is actuated to secure all of the components in the correct and fixed orientation.

Figure 31:
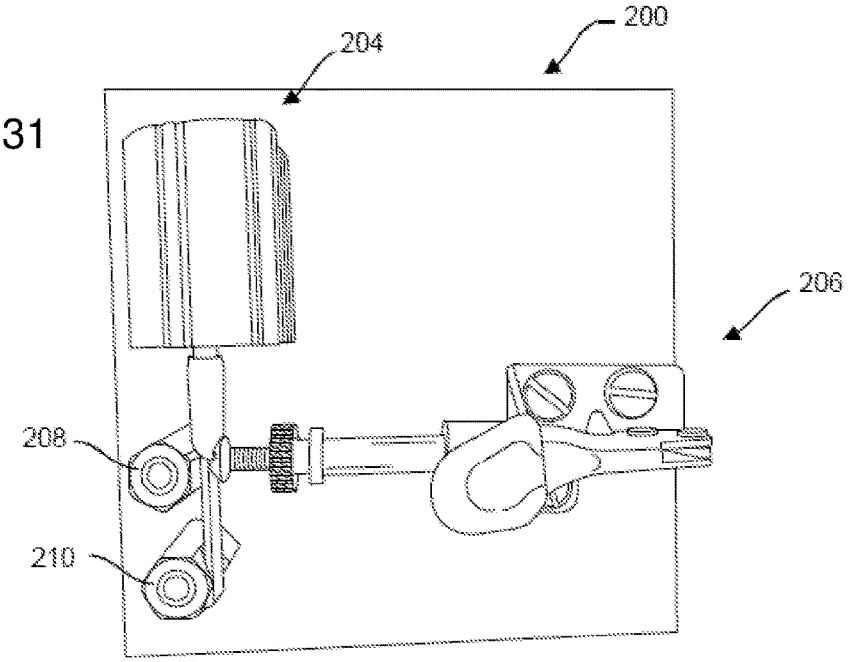
FIG. 31 is a top view of an alternative embodiment of a device for ligating a double reed in accordance with the principles of the invention.
Figure 32:
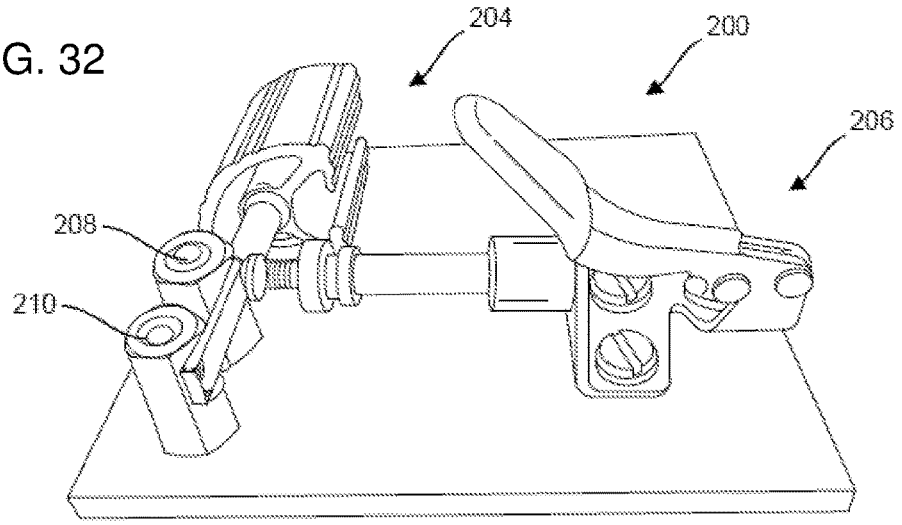
FIG. 32 is a perspective view of an alternative embodiment of a device for ligating a double reed in accordance with the principles of the invention.

FIGS. 31 and 32 show the device 200 having the toggle clamp 206 actuated such that the jaw plate 225 impinges upon the folded cane 248 opposite to the jaw groove 209, thereby clamping the folded cane 248 in a fixed position in the proper orientation over the staple 246 with the heat shrink tube 250 also secured in place between the staple stand 204 and the clamp mechanism formed from the combined fixed jaw post 208 and the jaw plate 225 of the toggle clamp 206. The lever 216 has been fully translated from the opening into the locked position. Heated air may now be applied to the device 200 so that the heat shrink tube 250 shrinks over the folded cane 248 and the staple 246 underneath it, thereby securely ligating the folded cane 248 to the staple 246.

The heatshield 234 protects the cork sleeve on the proximal region of the staple 246. In this embodiment, the heat shield 234 is separated from the central hole 230 by an insulating cavity 237. The dissipating arms 240 and the fins 238 of the staple stand frame 236 provide additional protection by dissipating any heat traveling from the heatshield 234 through the frame 236. This allows substantial heat, such as for example heated air from a blow dryer or similar device, to be vigorously applied to the heat shrink tube 250 without damaging the cork sleeve. While the folded cane 248 is less susceptible to damage from heat, the fixed jaw post 208 and reed alignment post 210 nonetheless provide some modest shielding from the heat to the reed 248.

The devices shown as alternative embodiments may all be used effectively. There are modest differences between them, such as the change in orientation of the folded cane as shown by the alignment of the crease. The use of an adjustable spindle having a jam nut allows a device in accordance with the principles of the invention to be adjusted for preparing components for mouthpieces of different sizes.

Whereas, the present invention has been described in relation to the drawings attached hereto, other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A device for ligating a double reed to a staple of a mouthpiece for a wind instrument comprising:

a horizontal, planar platform;

a staple mount having a central hole configured to engage and hold stationary a cork sleeve on a proximal end of a double reed staple;

a heatshield; and, a reed clamp configured to engage and hold stationary a folded cane positioned over a distal end of a double reed staple held stationary in the central hole of the staple mount;

wherein a distance between the reed clamp and an opening of the central hole is greater than a length of a heat shrink tube used to ligate the folded cane to the distal end of the double reed staple; and, wherein the reed clamp comprises a fixed jaw and a movable jaw configured to lie flush against and substantially surrounds the distal end of the double reed staple.

2. The device of claim 1 wherein the double reed staple has a cork sleeve retained within the central hole of the staple mount, and the heat shield extends over the cork sleeve of the staple.

3. The device of claim 1 wherein the staple mount is rotatably attached to the platform.

4. The device of claim 1 wherein the fixed jaw of the reed clamp is located on a stationary post extending upward from the platform and the movable jaw is actuated by a toggle clamp.

5. The device of claim 4 wherein the toggle clamp comprises: a lever that actuates a plunger to extend toward and retract away from the fixed jaw; an adjustable spindle at a distal end of the plunger; and a jam nut locking the adjustable spindle in a desired position; wherein the movable jaw is located at a distal end of the adjustable spindle.

6. A ligating stand for preparing a double reed for a mouthpiece of a musical instrument, the ligating stand comprising:

a planar base;

a staple mount rotatably attached to the planar base and having a tubular sleeve configured to hold a double reed staple having a cork sleeve, where in the tubular sleeve defines a longitudinal axis;

a heat shield over the staple mount;

a reed securing clamp comprising two opposing jaws, a first, stationary jaw comprising a notch on a post extending upward from the base and a second, moving jaw that translates between an open position and a closed position, thereby opening and closing the reed securing clamp;

wherein the reed securing clamp is located a distance from the staple mount, and the first and second jaws of the reed securing clamp close around the longitudinal axis defined by the tubular sleeve.

7. A method for ligating a cane to a staple for a double reed mouthpiece of a musical instrument comprising:

providing a ligating stand comprising:

a planar base;

a staple mount rotatably attached to the planar base and having a tubular sleeve configured to hold a double reed staple having a cork sleeve, where in the tubular sleeve defines a longitudinal axis;

a heat shield over the staple mount;

a reed securing clamp comprising two opposing jaws, a first, stationary jaw comprising a notch on a post extending upward from the base and a second, moving jaw that translates between an open position and a closed position, thereby opening and closing the reed securing clamp;

wherein the reed securing clamp is located a distance from the staple mount, and the first and second jaws of the reed securing clamp close around the longitudinal axis defined by the tubular sleeve;

providing a staple for a double reed mouthpiece comprising a metal tube having a distal end and a proximal end, with a cork sleeve over its proximal end;

inserting the proximal end of the staple into the tubular sleeve of the staple mount such that the distal end of the staple extends along the longitudinal axis of the sleeve in a direction toward the reed securing clamp;

placing a cylindrical piece of heat shrink tubing over the distal end of the staple and abutting the cork sleeve of the staple;

providing a piece of cane is folded in half having a distal end defined by a crease where the cane is folded and an open proximal end;

placing the open proximal end of the cane over the distal end of the staple and underneath the cylindrical piece of heat shrink tubing such that the open proximal end of the cane abuts the cork sleeve of the staple;

rotating the staple mount such that the piece of cane impinges on the stationary jaw of the reed clamp;

translating the moving jaw into the closed position such that it firmly holds the piece of cane over the distal end of the staple and underneath the piece of heat shrink tubing;

applying heated air to the piece of heat shrink tubing such that it securely attaches the piece of cane to the distal end of the staple.

* * * * *